United States Patent [19]

Nitanda et al.

[11] Patent Number: 4,621,919

[45] Date of Patent: Nov. 11, 1986

[54] METAL DRUM AND IMAGE HOLDING MEMBER USING THE SAME

[75] Inventors: Hiroshi Nitanda, Tokyo; Morikazu Mizutani; Taketoshi Yokoyama, both of Kawasaki; Jun Tamai; Toru Okumura, both of Yokohama, all of Japan

[73] Assignee: Canon Kabushiki Kaisha, Tokyo, Japan

[21] Appl. No.: 513,351

[22] Filed: Jul. 13, 1983

[51] Int. Cl.[4] ..... G03G 15/00

[52] U.S. Cl. ..... 355/3 DR; 355/3 R; 355/133; 355/14 R

[58] Field of Search ..... 355/3 DR, 3 SC, 3 R, 355/133, 14 R, 14 D; 29/123, 124, 125, 126, 127, 132; 101/375, 378

[56] References Cited

U.S. PATENT DOCUMENTS

| | | | |
|---|---|---|---|
| 2,860,048 | 11/1958 | Deubner | 96/1 |
| 3,124,456 | 3/1964 | Moore | 96/1 |
| 3,126,825 | 3/1964 | Tofano | 101/378 X |
| 3,146,145 | 8/1964 | Kinsella | 156/272 |
| 3,292,535 | 12/1966 | Cutler | 101/375 |
| 3,457,070 | 7/1969 | Watanabe et al. | 96/1.4 |
| 3,548,928 | 12/1970 | Kesten | 101/375 |
| 3,565,001 | 2/1971 | Zimmer | 101/378 X |
| 3,607,258 | 9/1971 | Hoegl et al. | 96/1.5 |
| 3,645,614 | 2/1972 | McFarlane, Jr. et al. | 355/3 |
| 3,666,363 | 5/1972 | Tanaka et al. | 355/17 |
| 3,680,954 | 8/1972 | Frank | 355/3 |
| 3,734,609 | 5/1973 | Tanaka et al. | 355/16 |
| 4,165,169 | 8/1979 | Miyashita et al. | 355/3 SC X |
| 4,223,993 | 9/1980 | Tsuda et al. | 355/3 R |
| 4,255,507 | 3/1981 | Ohara et al. | 430/53 |
| 4,298,278 | 11/1981 | Katakura et al. | 355/3 DR X |
| 4,364,313 | 12/1982 | Hyllberg | 101/375 X |
| 4,376,579 | 3/1983 | Wakao | 355/133 X |
| 4,386,839 | 6/1983 | Kumagai et al. | 29/123 X |
| 4,400,077 | 8/1983 | Kozuka et al. | 355/3 DR |
| 4,425,036 | 1/1984 | Kameyama et al. | 355/133 X |

FOREIGN PATENT DOCUMENTS

| | | | |
|---|---|---|---|
| 0159680 | 12/1981 | Japan | 355/3 DR |
| 7807649 | 2/1979 | Netherlands | 101/375 |

*Primary Examiner*—William M. Shoop, Jr.
*Assistant Examiner*—Shik Luen Paul Ip
*Attorney, Agent, or Firm*—Fitzpatrick, Cella, Harper & Scinto

[57] ABSTRACT

An image holding member for electrophotography has a metal drum, one side face of which is formed integrally with the peripheral face of the drum. And the image holding member has at the center of said side face a rotatory drum supporting shaft formed integrally with said side face.

27 Claims, 8 Drawing Figures

METAL DRUM AND IMAGE HOLDING MEMBER USING THE SAME

BACKGROUND OF THE INVENTION

1. Field of the Invention

This invention relates to an image holding member for electrophotography, having as the supporting drum a metal drum comprising one side face of the drum which is formed unitarily with the peripheral face of the drum, said metal drum having a rotatory supporting shaft formed integrally with the central portion of said side face.

2. Description of the Prior Art

Electrostatic images or toner images can be produced by various electrophotographic processes. And, the image holding members on which electrostatic images or toner images are formed may be classified into two groups of those having photoconductive layers called as the electrophotographic photosensitive members and those having no photoconductive layer.

An image forming member is generally constituted with a support and an image holding layer provided thereon.

Electrophotographic photosensitive members may have various constitutions in order to obtain desired characteristics depending on the kind of the electrophotographic process applied. As a typical example of electrophotographic photosensitive members, there have been widely used a photosensitive member having a photoconductive layer formed as the image holding layer on a support and a photosensitive member having lamination structure comprising a photosensitive layer and an insulating layer formed thereon as the image holding layer. The photosensitive member constituted with a support and a photoconductive layer is used for the most general electrophotographic process. That is, it is used for image formation by charging, image exposure and development, followed further by transfer, if desired. In the photosensitive member provided with an insulating layer, this layer is provided for various purposes such as protection of the photoconductive layer, improvement of the mechanical strength of the photosensitive member, improvement of dark decay characteristic or so as to be applied to a specific electrophotographic process. Typical examples of such photosensitive members having insulating layers or electrophotographic processes using the photosensitive members having insulating layers are disclosed in, for example, U.S. Pat. No. 2,860,048, Japanese Patent Publication No. 16429/1966, U.S. Pat. Nos. 3,146,145, 3,607,258, 3,666,363, 3,734,609, 3,457,070, and 3,124,456.

A certain electrophotographic process is applied on an electrophotographic photosensitive member to form an electrostatic image thereon, and the electrostatic image is developed to be visualized.

A typical constitution having no photoconductive layer has an insulating layer as the image holding layer. Typical processes using the image holding member of this type are mentioned below.

(1) A process as disclosed in Japanese Patent Publications Nos. 7115/1957, 8204/1957 and 1559/1968, for improving the durability of an electrophotographic photosensitive member against repetitive use, wherein development is carried out by transferring the electrostatic image formed on the electrophotographic photosensitive member onto an image holding member having no photoconductive member, followed by transfer of the toner image to a recording member.

(2) As another electrophotographic process for forming an electrostatic image on an image holding member having no photoconductive member corresponding to the electrostatic image formed on the electrophotographic photosensitive member, a process wherein an electrostatic image is formed by a certain electrophotographic process on a screen-shaped electrophotographic photosensitive member having numerous minute openings, corona charging treatment is performed through said electrostatic image on an image holding member having no photoconductive member thereby to form the electrostatic image on the image holding member having no photoconductive member through modulation of the ion streams of corona, which is then subjected to toner development and transferred onto a recording member to form the final image, as disclosed in U.S. Pat. Nos. 3,680,954, 3,645,614 and 4,255,507.

(3) According to still another electrophotographic process, a process wherein toner images formed on an electrophotographic photosensitive member or an image holding member having no photoconductive layer are transferred onto another image holding member having no photoconductive layer without directly transferring onto a recording member, and the transferring the images on the recording member, followed by fixing. This process is particularly effective for formation of color images or high speed copying. As a recording member, a flexible material such as paper or a film is generally used. For this reason, it is more effective for forming color images with accurate registration to transfer the tricolor images on an image holding member substantially free from deformation and to transfer the images at once on a recording member rather than to transferring the tricolor images while performing registration accurately. it is also effective for speed-up of copying that the toner images is transferred through the image holding member onto a recording member.

(4) As still another process, a process wherein electrical signals are applied on a multi-needle electrode to form electrostatic images corresponding to the electrical signals on the surface of an image holding member having no photoconductive layer, which are then developed to form images.

An image holding member to be used for electrophotography is liable to be damaged, because it is exposed to various electrical and mechanical shocks as by corona charging treatment, developing treatment, cleaning treatment and others. And, once an image holding member is damaged, the quality of the images formed is markedly lowered. Thus, it is a general practice to replace the image holding members with lowered performance with a good one. Accordingly, image holding members are also articles of consumption, and therefore they are required to be excellent in easiness of manufacture, cost, etc. Whereas, the element from the standpoint of manufacture and cost in the image holding members of the prior art, which has been deemed to be the most crucial problem, is the support. As the support, a metal drum is used as a general practice. Most of the metal drums employed are formed by casting a molten metal into a mold having an annular opening and then cooling the metal while the metal passes through said annular opening portion, namely according to the so called extrusion molding. However, a metal drum prepared by such a process, since it is prpared by drawing from a mold, has a thick wall to give a heavy metal drum. Also, the metal drum thus formed has none of both side faces, and therefore, in order to be mounted as the image holding member on the body of a copying device, flanges as the bonding members have to be separately formed and set up to both ends of the metal drum, and therefore a number of working steps are necessary for manufacture. As a metal drum which overcomes this problem, Japanese Laid-open Patent Application No. 159680/1981 proposes a metal drum in which one side face of the drum is formed integrally continuous to the peripheral face of the drum. However, for forming good images by rotating the image holding member within the electrophotographic apparatus, the fluctuation of rotating surface must be suppressed to 30μ or less. Whereas, the metal drum disclosed in the above laid-open patent application, due to the absence of a rotatory supporting shaft, the projection-recess portion for driving formed on the side face of the metal drum must be formed very precisely in order to permit the metal drum to rotate with high precision, and further the corresponding projection-recess portion for driving the metal drum must also be very precisely formed. However, it is not easy to form these projection-recess portions very precisely. Further, due to absence of a rotatory supporting shaft, the metal drum is required to be supported by these projection-recess portions, which should be in a shape of sufficient strength to function as the supporting section or to have a large thickness. Besides, generally speaking, in an electrophotographic apparatus, the metal drum needs to be conductive to the body of an electrophotographic machine. However, in the metal drum disclosed in the above laid-open patent application, due to absence of a rotatory supporting shaft, for conductive connection to the body of the electrophotographic machine, the driving and transmitting members for rotatory driving of the metal drum are required to be made all of a metal, whereby inconveniences occur in the use of parts of light-weight or low cost such as plastic gears, etc.

SUMMARY OF THE INVENTION

An object of the present invention is to provide an image holding member with rotatory precision.

Another object of the present invention is to provide an rotating image holding member which can be supported stably.

Still another object of the present invention is to provide an image holding member which can easily be conductively connected to the body of an electrophotographic apparatus.

Still another object of the present invention is to provide an image holding member having a metal drum excellent in rotational precision and rotatory supporting strength albeit it is very thin.

According to an aspect of the present invention, there is provided the image holding member for electrophotography having a metal drum, one side face of which is formed integrally with the peripheral face of the drum, which has a rotatory supporting shaft at the center of said side face formed integrally with said side face.

According to another aspect of the present invention, the metal drum to be used in the image holding member has a rotatory supporting shaft to enhance easily the rotational precision and, at the same time, the rotatory supporting shaft, which is formed integrally with the side face of the metal drum, is very tough as a rotatory supporting shaft, thus enabling the metal drum to be light weight and thin as a whole. Also, through the rotatory supporting shaft, a conductive connection to the body side of an electrophotographic device can easily be effected.

DESCRIPTION OF THE PREFERRED EMBODIMENT

Figure 1:
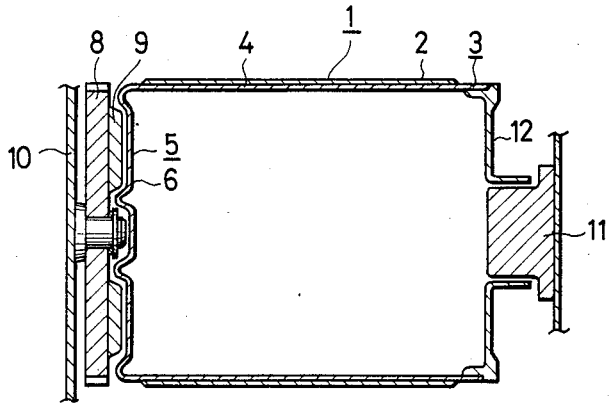
FIG. 1 PRIOR ART
FIG. 1 is a sectional view of the image holding member of the prior art.

Referring now to the drawings, the present invention is to be described in detail.

Figure 2:
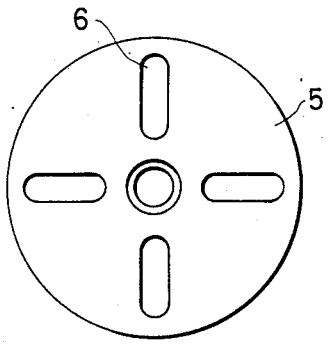
FIG. 2 PRIOR ART
FIG. 2 is a plan view of the side face of the metal drum shown in FIG. 1.
Figure 3:
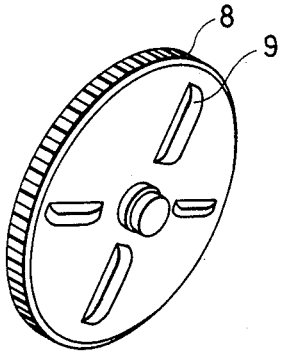
FIG. 3 PRIOR ART
FIG. 3 is a perspective view of the joining gear shown in FIG. 1.

FIG. 1 is a sectional view of the image holding member of the prior art as disclosed in the aforesaid Laid-open Patent Application. The image holding member 1 comprises an image holding layer 2 formed on the peripheral face 4. On the side face 5 of the metal drum 3 is formed a recess portion for driving the metal drum. This recess portion 6 is engaged with the projection 9 formed on the surface of the joining gear 8, and through rotation of the joining gear 8 equipped on the side of the body 10 of an electrophotographic device, its rotational force is transmitted to the metal drum, thereby making the metal drum rotate. The other end portion of the drum is opened and equipped with a flange 12 so as to be ratatable around the shaft 11. FIG. 2 is a plan view of the side face 5 of the metal drum, in which the recess portion is formed in the shape of a cross. FIG. 3 is a perspective view of the joining gear 8, and on the surface of the joining gear are formed projections 9. In case of the metal drum as shown in FIG. 1, there is no rotatory shaft, and the metal drum is supported by the projection 9 and the recess portion 6 and therefore the rotational precision of the metal drum depends on the position and the precision of the projection 9 and the recess portion 6. Whereas, it is not easy to form accurately the position and the shape of the projection 9 and the recess portion so that no fluctuation of a rotating surface occurs. Also, even when a slight deformation formed at the projection and recess portions during rotation by application of the rotational driving force may be a cause to give rise to a fluctuation of a rotating surface. Besides, when the metal drum is intended to be conductively connected to the body 10, the joining gear must be made of a metal to result in the disadvantage that a light-weight and low-cost plastic gear cannot be used. In this connection, it is difficult to provide a conductive connection at the side of the flange, because an insulating lubricant oil is applied on the shaft 11.

Figure 4:
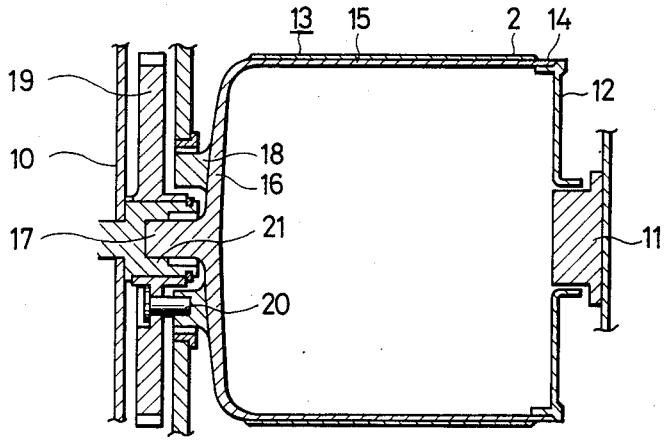
FIG. 4 is a sectional view of an image holding member according to this invention.
Figure 5:
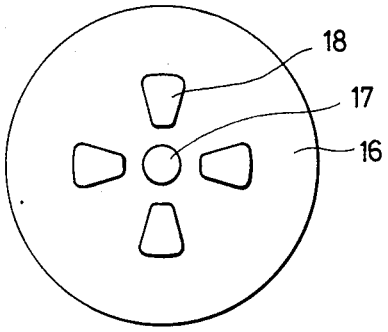
FIG. 5 is a plan view of the side face of the metal drum shown in FIG. 4.
Figure 6:
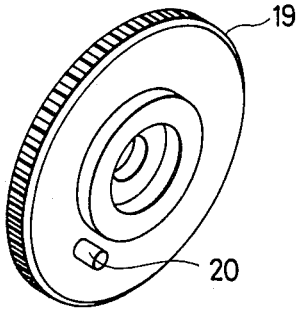
FIG. 6 is a perspective view of the joining gear shown in FIG. 4.

FIG. 4 shows an embodiment of the image holding member according to this invention. In the image holding member 13, an image holding layer 2 is formed on the peripheral face 15 of the metal drum 14. At the side face 16 of the metal drum 14 are formed the rotary supporting shaft 17 and the projection portions 18 for driving the metal drum integrally continuous to the side face. The body 10 of an electrophotographic device is equipped with a bearing 21 and a joining gear 19 having a hook 20 on the surface, said hook 20 and the projection portion 18 being arranged so as to be contacted with each other, and the metal drum can be rotated by rotation of the joining gear 19. The metal drum 14 is equipped at the other end with a flange 12, which is supported on the shaft 11. FIG. 5 is a plan view of the side face 16 of the metal drum, in which the rotatory supporting shaft 17 and the projection portions 18 are formed integrally with the side face. FIG. 6 is a perspective view of the joining gear 19 having a hook 20 on the surface. As described above, since the metal drum 14 has a rotatory supporting shaft 17 formed integrally, the precision of rotation of the metal drum can be determined only by the rotatory supporting shaft. And, by having the rotatory supporting shaft positioned at the center of the side face of the metal drum, there occurs no fluctuation of the surface during rotation. Whereas, it is generally easy in designing to provide a rotatory supporting shaft at the center of a metal drum, and therefore the precision of rotating surface of the metal drum can be improved very much by the rotatory supporting shaft. Also, since the rotatory supporting shaft is formed integrally with the side face of the metal drum, it is excellent in mechanical strength, and therefore no deformation will occur at the rotatory supporting shaft 17, even when there may be formed deformation at the projection portion 18 receiving the driving force during rotation of the metal drum. Thus, high rotational precision of the metal drum can be maintained. Also, the rotatory supporting shaft is formed integrally with the metal drum and made of a metal, and therefore it can be easily conductively connected to the body side of an electrophotographic device through, for example, the tip surface of the rotatory supporting shaft. The thicknesses of the metal drum at the peripheral face and the side face may be the same, but the thickness at the side face should preferably be made greater than that on the peripheral face by, for example, 1.2-fold or more, in order to make the weight of the metal drum as small as possible and increasing the strength of the rotatory supporting shaft.

As an example of the method for preparation of the metal drum as shown in FIG. 4, there may be employed the method according to impact extrusion working. Preparation of a metal drum by impact extrusion working of a metallic material may be conducted by applying an impact with a punch on a slug (metal piece to be worked) placed on a mold, whereby the slug is deformed momentarily to be formed into a cylinder. The metal drum thus formed is good in surface smoothness, and the polishing treatment as the secondary working can be made unnecessary or alleviated. During this working, by use of a mold having recess portions corresponding to the rotatory supporting shaft 17 and the projection portion 18, there can be produced a metal drum momentarily having the rotatory supporting shaft and the projection portion 18 integrally formed.

As a material of the drum, there may be used suitably various metals, as exemplified by aluminum, tinplate, iron, brass, etc.

The metal drum may have a thickness generally of 0.1 to 5 mm, particularly preferably about 0.2 to 1.5 mm. Also, the metal drum may have a surface smoothness of from 0.1 s to 10 s, particularly preferably from 1 s to 3 s. Here, "s" means that the maximum height of the surface roughness is 1$\mu$ according to JIS B0601.

Figure 7:
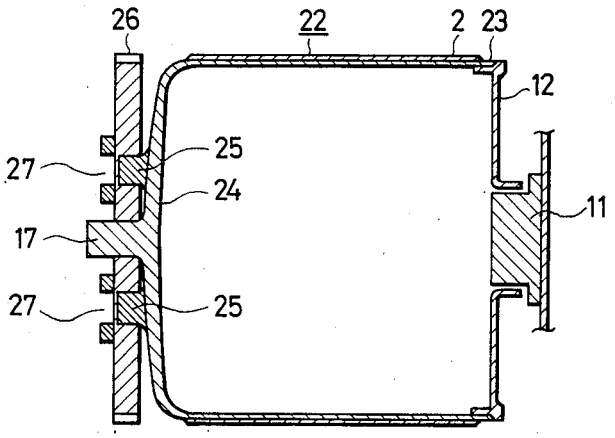
FIG. 7 is a sectional view of another image holding member according to this invention.
Figure 8:
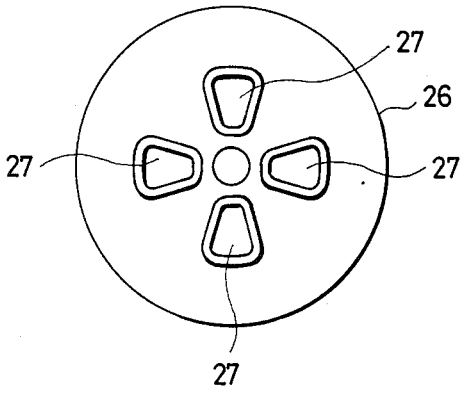
FIG. 8 is a plan view of the joining gear shown in FIG. 7.

As a modification of the image holding member according to the present invention, there may be included an embodiment in which a member having an engaging portion for driving rotationally the metal drum by external driving is fixed on the rotatory supporting shaft. The image forming member shown in FIG. 7 is one example of said embodiment. The image holding member 22 has a metal drum 23 having the rotatory supporting shaft and the projection 25 formed integrally with the side face. As a member having an engaging portion for rotating the metal drum, joining gears 26 having engaging recesses 27 are fitted to the projections 25 and fixed on the rotatory supporting shaft. FIG. 8 is a plan view of the joining gear 26, having engaging recess 27 formed on its surface. In this image holding member, the external rotational driving force can be transmitted to the engaging recess 27 by means of, for example, a hook 20 shown in FIG. 6 thereby to rotate the metal drum 23. Accordingly, the metal drum is not directly contacted with the hook, whereby damaging or deformation of the metal drum can effectively be prevented. Also, the gear portion of the joining gear 26 can be utilized for transmitting the driving force for driving a cleaning means or developing means to be arranged around the image holding member.

As the image holding layer, there may be employed a photoconductive layer or a laminate of a photoconductive layer and an insulating layer, when the image holding member is an electrophotographic photosensitive member.

The photoconductive layer may be formed by vacuum deposition of an inorganic photoconductive material such as Si, Se, PbO, and an alloy or an intermetallic compound comprising S, Se, Te, As, Sb, etc. In the case where the sputtering method is employed, a high melting photoconductive material such as ZnO, CdS, CdSe, $TiO_2$, etc. is made to adhere onto a support to provide a photoconductive layer. Alternatively, when a photoconductive layer is formed by coating, there may be employed an organic photoconductive material such as polyvinylcarbazole, anthracene, phthalocyanine, etc., or these materials sensitized with a dye or a Lewis acid, or further mixtures of these materials with insulating binders. Mixtures of inorganic photoconductive materials such as ZnO, CdS, $TiO_2$, PbO, etc. with insulating binders may also suitably be employed. As insulating binders, various resins may be available. The photoconductive layer may have a thickness, which depends on the kinds or characteristics of the photoconductive material employed, but generally ranges from 5 to 100$\mu$, particularly preferably from 10 to 50$\mu$.

The insulating layer may be formed of a resin such as polyethylene, polyester, polystyrene, acrylic resin, polycarbonate, silicon rubber, epoxy resin, etc. When the image holding member has no photoconductive layer, the image holding member is constituted with an insulating layer as mentioned above.

What is claimed is:

1. An image holding member for electrophotography having a metal drum, wherein said drum has first and second side faces, said first side face being formed integrally with the peripheral surface of the drum, characterized in that the image holding member has a rotatory shaft formed integrally at the center of said first side face, and has at least one formation on said first side face for receiving an external rotational driving force to rotate the metal drum, wherein the integrally formed rotary shaft and the formation are spaced from said second side face.

2. An image holding member according to claim 1, wherein the engaging member is a gear.

3. An image holding member according to claim 1, wherein the thickness of the side face having the rotatory shaft formed thereon is thicker than that of the peripheral face.

4. An image holding member according to claim 1, characterized in that the wall thickness of the side face of the metal drum is larger than the wall thickness of the peripheral face of the metal drum, the wall thickness of the central portion of the side face being larger than the wall thickness of the peripheral portion thereof.

5. An image holding member according to claim 4, wherein the thickness of the side face of the metal drum is continuously increased from the peripheral portion towards the central portion.

6. An image holding member according to claim 1, characterized in that the wall thickness of the side face of the metal drum is larger than the wall thickness of the peripheral face and the wall thickness of the central portion of the side face is larger than the wall thickness of the peripheral portion thereof.

7. An image holding member according to claim 6, the wall thickness of the side face is continuously increased from the peripheral portion toward the central portion.

8. An image holding member according to claim 6, wherein the image holding layer comprises a photoconductive layer.

9. An image holding member according to claim 6, wherein the image holding layer comprises an insulating layer.

10. An image holding member comprising an image holding layer and a metal drum, wherein said drum has first and second side faces, said first side face being formed integrally with the peripheral face of the drum, characterized in that the image holding member has a rotatory shaft formed integrally at the center of said first side face, and has least one formation on said first side face for receiving an external rotational driving force to rotate the metal drum, wherein the integrally formed rotary shaft is spaced from said second side face.

11. An image holding member according to claim 10, wherein the engaging member is a gear.

12. An image holding member according to claim 10, wherein the wall thickness of the side face having the rotatory shaft formed thereon is larger than the wall thickness of the peripheral face.

13. An image holder member according to claim 10, wherein said another member is a cleaning means.

14. An image holding member according to claim 10, wherein said another member is a developing means.

15. An image holding member according to claim 10, wherein the image holding layer comprises a photoconductive layer.

16. An image holding member according to claim 10, wherein the image holding member comprises an insulating layer.

17. An image holding member according to claim 16, wherein said rotary shaft is provided with an engaging member for driving another member.

18. A metal drum, wherein said drum has first and second side faces, said first side face being formed integrally with the peripheral face of the drum, characterized in that the image holding member has a rotatory shaft formed integrally at the center of said first side face, and has at least one projection on said first side face for receiving an external rotational driving force to rotate the metal drum, wherein the integrally formed rotatory shaft is spaced from said second side face.

19. The image holding member according to claim 18, wherein the engaging member is a gear.

20. A metal drum according to claim 18, wherein the wall thickness of the side face having the rotatory shaft formed thereon is larger than the wall thickness of the peripheral face.

21. A metal drum according to claim 18, wherein said metal drum is formed by impact extrusion molding of a metal.

22. The device according to claim 18, wherein said rotary shaft is provided with an engaging member for driving another member.

23. A method of making an electrical conductive connection between an image holding member and a main body of an electrophotographic device, characterized in that the image holding member comprises an image holding layer and a metal drum, one side face of the metal drum being formed integrally with a peripheral face of the drum, a rotatory shaft being formed continuously and integrally with the side face, and in that the electrical conductive connection to the main body of the electrophotographic device is made through the rotatory shaft.

24. A method according to claim 23, wherein the metal drum is formed from aluminum.

25. A method of making an electrical conductive connection between an image holding member and a main body of an electrophotographic device, characterized by forming the image holding member with an image holding layer and a metal drum, by providing the metal drum with first and second side faces, said first side face being formed integrally with a peripheral face of the drum, by providing a rotatory supporting shaft formed continuously and integrally with said first side face, by providing said electrical conductive connection to the main body of the electrophotographic device through the rotatory supporting shaft, and by maintaining said shaft spaced from said second side face.

26. An image holding member for electrophotography having a metal drum, wherein said drum has first and second side faces, said first side face being formed integrally with the peripheral surface of the drum, characterized in that said image holding member has a rotatory shaft formed integrally at the center of said first side face, and said rotary shaft is spaced from said second side face.

27. An image holding member according to claim 1 wherein said rotary shaft is provided with an engaging member for driving another member.

* * * * *

UNITED STATES PATENT AND TRADEMARK OFFICE

CERTIFICATE OF CORRECTION

PATENT NO. : 4,621,919

DATED : November 11, 1986

INVENTOR(S) : HIROSHI NITANDO, ET AL.

It is certified that error appears in the above-identified patent and that said Letters Patent is hereby corrected as shown below:

COLUMN 2

Line 26, "the" should read --then--.
Line 36, "to transferring" should read --transfer--.
Line 37, "it" should read --It--.
Line 38, "is" should read --are--.
Line 67, "prpared" should read --prepared--.

COLUMN 3

Line 46, "an" should read --a--.

COLUMN 4

Line 40, "opened" should read --open--.
Line 41, "ratatable" should read --rotatable--.

COLUMN 6

Line 39, before "photoconductive" insert --point--.

COLUMN 7

Line 28, "the wall" should read --wherein the wall--.
Line 43, "has least" should read --has at least--.
Line 53, "holder" should read --holding--.

UNITED STATES PATENT AND TRADEMARK OFFICE

CERTIFICATE OF CORRECTION

PATENT NO. : 4,621,919

DATED : November 11, 1986

INVENTOR(S) : Hiroshi Nitando, et al

It is certified that error appears in the above-identified patent and that said Letters Patent is hereby corrected as shown below:

Column 8, line 1, "16" should read -- 10 --.

Signed and Sealed this

Thirty-first Day of March, 1987

*Attest:*

*Attesting Officer*

DONALD J. QUIGG

*Commissioner of Patents and Trademarks*